United States Patent [19]

Breslow et al.

[11] 4,169,334

[45] Oct. 2, 1979

[54] ROLLING TOYS

[75] Inventors: Jeffrey D. Breslow, Highland Park; Wayne A. Kuna, Elmhurst; Eugene Jaworski, Park Ridge, all of Ill.

[73] Assignee: Marvin Glass & Associates, Chicago, Ill.

[21] Appl. No.: 867,523

[22] Filed: Jan. 6, 1978

[51] Int. Cl.[2] ..... A63H 11/10

[52] U.S. Cl. ..... 46/103; 46/201; 46/207; 46/221

[58] Field of Search ..... 46/100, 103, 104, 201, 46/202, 209, 207, 221

[56] References Cited

U.S. PATENT DOCUMENTS

| | | | |
|---|---|---|---|
| 1,223,287 | 2/1917 | Morse | 46/104 |
| 2,686,387 | 8/1954 | Patremio | 46/100 |
| 2,802,300 | 8/1957 | Rogers | 46/100 |
| 3,233,358 | 2/1966 | Dehm | 46/221 |

*Primary Examiner*—Louis G. Mancene
*Assistant Examiner*—Robert F. Cutting
*Attorney, Agent, or Firm*—Mason, Kolehmainen, Rathburn & Wyss

[57] ABSTRACT

A rolling toy comprises a pair of wheels mounted on a common axle with inside faces of the wheels in spaced-apart relation. A body is mounted for free rotation on the axle between the inside faces of the wheels and includes a head portion projecting upwardly of the wheels and a lower portion below the axle. Balance weight means is provided in the lower portion for maintaining the head portion in an upright position as the wheels rotate. The head portion may be fashioned in a variety of different ways to represent clowns, elfs and other characters, and the rolling toys are adapted to be coaxially aligned and engaged with one another in a side by side cluster to roll in unison as a group.

In addition, the toys are especially adapted for use with a variety of different types of play apparatus such as wheeled vehicles, rolling rings, swings, ramps, cages and the like. The rolling toys individually, in groups and in combination with the various other play apparatus of the invention provide entertainment and interest for young children.

36 Claims, 10 Drawing Figures

ROLLING TOYS

BACKGROUND OF THE INVENTION

1. Field of the Invention

The present invention relates to rolling toys and more particularly to rolling toys adapted for use by young children. More particularly, the rolling toys of the invention are suitable for use in combination with each other and in combination with other play apparatus such as rolling rings, swings, cages, wheels, wheeled vehicles, ramps and the like.

2. Description of the Prior Art

A wide variety of rolling toys have been developed for use by young children and these types of toys provide many long hours of entertainment and interest. Prior art rolling toy devices have sometimes been utilized in conjunction with other game apparatus for making a child's play more interesting. However, as far as known, none of the prior art devices provide the new and unique approach to rolling toys in combination thereof with one another and other game apparatus as in the present invention.

SUMMARY OF THE INVENTION

It is an object of the present invention to provide a new and improved rolling toy including a body mounted for free rotation on an axle between a pair of rolling wheels on either side and including a balance weight for maintaining the body in upright position as the wheels rotate.

More particularly, it is an object of the invention to provide a new and improved rolling toy of the character described wherein key means are provided on the outer surfaces of the toy wheels for interconnecting two or more of the rolling toys together with the wheels in coaxially aligned relation so that the toys may roll together in unison with one another.

Yet another object of the present invention is to provide a new and improved rolling toy of the character described in combination with a ramp assembly wherein the rolling toy is first lifted or elevated to a high level position and then rolls down a ramp to engage to a discharge gate at the lower end of the ramp, which gate is operative to deliver the toy into an awaiting wagon or other wheeled vehicle which then rolls down a guideway.

Still another object of the invention is to provide a rolling toy of the character described adapted to be removably mounted between a pair of swing apparatus which can be manually rotated around an elevated shaft to swing the toy around a circular path while a head portion of the toy is always maintained in an upright position.

Another object of the invention is to provide a rolling toy of the character described in combination with a pair of relatively larger circular rings having recesses adapted to receive one or more of the toys at radially spaced positions outwardly of a central shaft interconnecting the rings so that as the rings roll along a surface, the toys will rotate therewith and the head portions of the toy will always be maintained in an upright condition.

Yet another object of the present invention is to provide a rolling toy of the character described which is adapted for use in a wheeled vehicular toy and which is used as a drive element in the vehicle for moving an auxiliary portion such as a front end scoop in reciprocating fashion as the vehicle is moved.

Still another object of the invention is to provide a new and improved rolling toy of the character described in combination with a cage-like track structure having a plurality of curved track segments which are independently pivotal around a common shaft and are freely movable to provide a moving circular track so that the segments can be rotated manually to lift the rolling toy to an elevated position wherein another track segment then pivots around to a pick up position for receiving the toy from the other elevated segment.

These and other objects and advantages of the present invention are accomplished in a preferred embodiment which comprises a new and improved rolling toy having a pair of wheels mounted on a common axle with the inside faces of the wheels in spaced apart relation in order to accommodate a toy body which is mounted for free rotation on the axle between the inside faces of the wheels. The body includes a head portion projecting upwardly above the wheels and a lower portion below the axle with a balance weight provided in the lower portion within the wheels for maintaining the head portion in a continuing upright position even as the wheels are rotated or the toy is elevated and moved in a variety of different fashions.

The rolling toy is used in combination with other rolling toys which may be interlocked or keyed together in side by side relation to roll along in unison. In addition, the rolling toy can be utilized with a wheeled vehicle and serves as a driving element in the vehicle for moving an auziliary scoop or bucket in reciprocating fashion as the vehicle is moved along. The rolling toy is also adapted for use in combination with a ramp system wherein the toy is elevated by a lift at one end to a higher level of the ramp for movement down the ramp toward a discharge gate, which gate then lowers and delivers the toy into an awaiting wheeled vehicle such as a wagon which then rolls down a sloping guideway. The toys are also adapted to be used in combination with pairs of larger rolling rings and are accommodated in radial positions between the rings so that as the rings roll along the rolling toys continuously maintain the body in an upright position even though the toy moves around a circular path along with the rings. Another usage of the toy is in combination with a swing set wherein a toy is carried at the outer end of a pair of spaced apart arms which swing around a circular path as a shaft is manually rotated. The rolling toys are also adapted to be used in conjunction with a cage-like track structure comprising a plurality of segments of circularly curved track, which segments are mounted on a common axle or shaft for independent rotation and are movable about a circular path to raise the toy to a higher level until it then moves into the next track segment which forms a continuing path for the toy as it rollingly moves toward the bottom of the cage-like structure.

BRIEF DESCRIPTION OF THE DRAWINGS

For a better understanding of the present invention reference should be had to the detailed description takn in conjunction with the drawings, in which.

DESCRIPTION OF THE PREFERRED EMBODIMENTS

Figure 4:
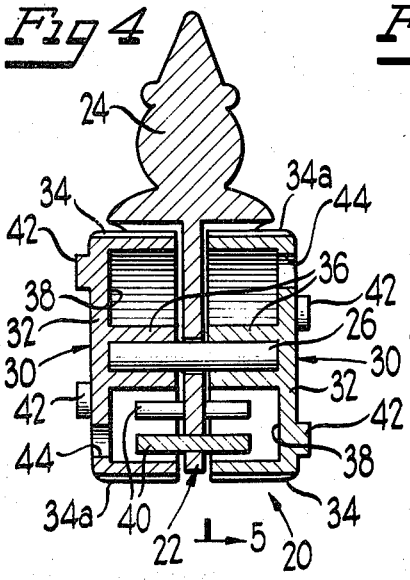
FIG. 4 is a vertical, sectional view taken through a central axis of a rolling toy constructed in accordance with the features of the present invention.
Figure 5:
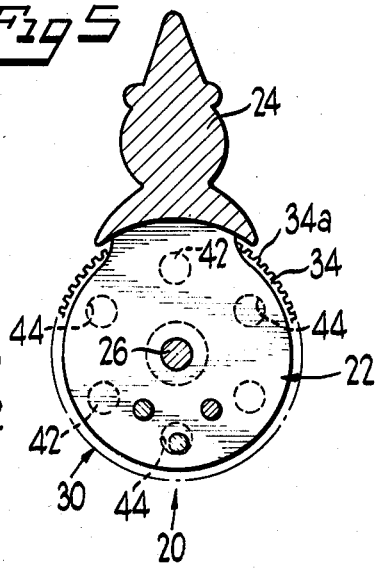
FIG. 5 is a longitudinal sectional view taken substantially along lines 5—5 of FIG. 4.

Referring now more particularly to the drawings, in FIGS. 4 and 5 is illustrated a new and improved rolling toy constructed in accordance with the features of the present invention and referred to generally by the reference numeral 20. The rolling toy 20 includes an upstanding body 22 with a lower portion of relatively thin material and having an integral, relatively enlarged head 24 at the upper end which extends laterally outwardly from opposite sides of the thin portion as shown in FIG. 4. The body is mounted for free rotation on a transverse axle 26 on which are secured a pair of generally cylindrical support wheels 30, each wheel having a circular outer sidewall 32, a cylindrical, annular outer rim 34 integral therewith and having a plurality of teeth 34*a* formed on the outer surface. The wheels also include cylindrical, tubular, inner hubs 36 adapted to accommodate opposite end portions of the axle which project oppositely outward from the opposite side faces of the lower portion of the body 22.

Between the outer rim 34 and the tubular hub 36, each wheel defines an inside, annular open space 38 and in the lower portion of these spaces in both wheels of the toy a pluality of balance weights 40 are provided. These weights extend transversely through apertures in the lower portion of the body 22 below the axle as shown in FIGS. 4 and 5. Preferably, the balance weights take the form of cylindrical rods of relatively dense material such as metal and the rods act to maintain the body with the head portion 24 in an upstanding position as the wheels 30 rotate and the toy is moved during play. The body, wheels and axle of the rolling toys 20 are preferably formed of molded plastic material and the balance weights 40 may be formed of any suitably dense material to provide the necessary balancing weight as needed for maintaining the head 24 in an upright position. As illustrated in FIG. 4, the inner edges or faces of the rim 34 and the hub 36 of the opposing wheels are spaced apart to accommodate the thin body 22 so that the body may freely rotate relative to the axle 26. The wheels on the other hand, are fixedly secured to the axle and rotate in unison therewith.

Figure 7:
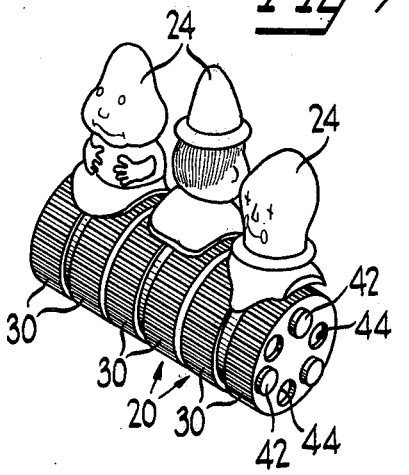
FIG. 7 is a perspective view of a plurality of rolling toys in accordance with the present invention interconnected together to move in unison.

In accordance with the invention, each wheel is provided with a plurality of outwardly extending cylindrical key-like projections 42 integrally formed on the outer faces of the wheel sidewalls 32 and spaced equilaterally and radially outwardly with respect to the axis of rotation of the wheels. As shown in the drawings, two, three or more projections may be provided on each wheel and these projections form an interlocking key means wherein each projection is adapted to be received in an appropriately spaced circular opening 44 provided in the wheel sidewall 32 of an adjacent rolling toy so that a plurality of the rolling toys may be detachably interconnected as shown in FIG. 7. In this arrangement the key projections 42 of one rolling toy are press fitted into the key recesses 44 in the wheel of an adjacent toy and the toys are thus maintained in coaxial alignment as shown in FIG. 7. As illustrated, the head portions 24 of each toy may be different from the others and the heads may be decorated and shaped to resemble different faces such as clowns, ghosts and other imaginary characters which children enjoy to play with. Physical attachment of the toys 20 together as shown in FIG. 7, is easily achieved by first aligning the key projections 42 of one toy with the recesses 44 on the wheel of an adjacent toy and then moving the toys together tightly in coaxial alignment. The press fit between the keys and recesses is sufficient to hold the toys together during normal play and the toys may be manually pulled apart when separation is desired. Two, three, four or more of the toys may be assembled together and the wheels 30 of all the toys are locked to roll in unison with the head portions maintained in upright positions by the balance weight 40 in each toy. As illustrated in FIG. 7, the head portions may face in opposite directions depending on which sides of the toys are assembled together.

Figure 1:
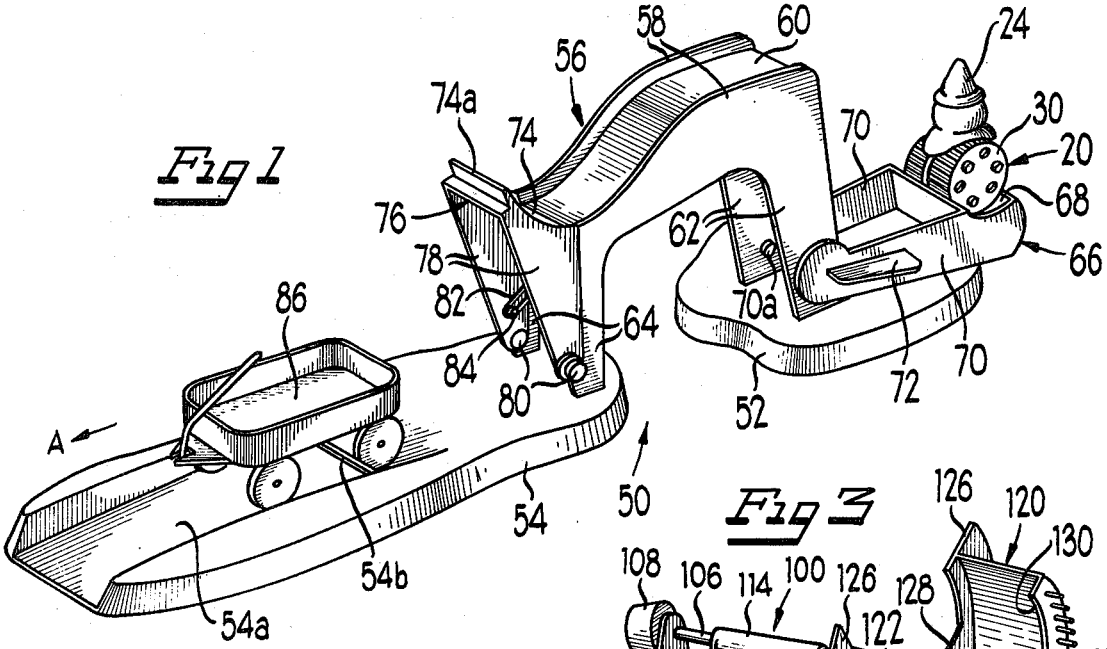
FIG. 1 is a perspective view of the new and improved rolling toy game apparatus combination in accordance with the features of the present invention.

Referring now to FIG. 1, therein is illustrated a rolling toy 20 in combination with a ramp assembly generally indicated by the reference numeral 50. The ramp assembly includes a pair of spaced apart base members 52 and 54 with a bridge-like structure 56 spanning the gap or space between the bases. The bridge is formed with a pair of spaced apart, inverted, generally U-shaped sidewalls 58 which are interconnected along an upper bight portion by means of a ramp 60 which slopes downwardly from a right hand or entry end above the base 52 to a lower left hand or exit end above the base 54. The upper edges of the sidewalls 58 extend upwardly above the level of the ramp 60 to provide side fences or guides for the rolling toys 20 as they roll down the ramp from the upper end towards the lower end. The spacing between the inverted U-shaped side members 58 of the bridge structure 56 is slightly greater than the spacing between the outer side faces 32 of the wheels 30 of the rolling toys, so that the toys may roll freely down the ramp from the upper level towards the lower level. The U-shaped side members of the bridge structure are formed with downwardly extending legs 62 and 64, respectively, which are supported at their lower ends on the upper wall or floor of the respective bases.

In accordance with the invention, the rolling toys 20 are elevated or lifted from a lower level adjacent the floor of the base 52 to an upper level adjacent the entry or higher end of the ramp 60 and this is accomplished by a pivotal lift or elevator 66 which is also of a generally U-shape having a concave pocket or cradle 68 for receiving a rolling toy in the bight portion between the legs at the outer ends. The lift includes a pair of spaced apart legs 70 which are pivotally attached adjacent lower ends of the spaced apart legs 62 of the bridge structure 56. Pivotal attachment is achieved by means of integral pins 70*a* which snap into circular openings provided in the legs 62. In order to rotate the elevator or lift upwardly from a lower, generally horizontal, receiving position as shown to an upstanding position with the legs 70 extending generally upright for discharging a toy from the cradle onto the upper end of the ramp 60, the legs are provided with outwardly extending finger tabs 72 which are conveniently grasped between the fingers for manually rotating the legs in a counterclockwise direction in order to deposit a rolling toy 20 onto the upper end of the ramp 60. As the lift is pivoted upwardly, the balance weights 40 in the toy maintain the head 24 in an upright position and when an inside edge of the lift cradle 68 strikes the right hand, edge face of the ramp 60, the pivotal movement of the lift is stopped and the rolling toy is forcefully ejected from the cradle out onto the ramp. The toy then begins to roll freely down the slope of the ramp towards the lower opposite end. As the toy rolls down the ramp, the head 24 is continuously maintained in an upright position by the internal balance weights 40. The upper edge portions of the sidewalls 58 guide and maintain the toy on the sloping ramp 60 and prevent the toy from falling off to one side or the other.

When the rolling toy reaches the lower or discharge end of the ramp, the toy encounters another curved, cradle 74 on a bight portion of a discharge gate 76 which includes a pair of spaced apart legs 78 pivotally secured to the lower end portions of the legs 64 of the bridge structure 56. The lower end portion of the legs 78 and the bridge structure legs 64 are pivotally interconnected by means of pivot axles 80 and one or more rubberbands 82 extending between pins 84 on the legs 78 and similar pins (not shown) on the bridge structure 56 bias the discharge gate into the upright position as shown. In this position, the curved cradle 74 is in a ready position for receiving a rolling toy 20 moving down the ramp 60 and the impact of the toy against the cradle pivots the discharge gate downwardly to a generally horizontal or toy releasing position. Outwardly of the discharge gate, the base 54 is provided with a ramp or guideway 54*a* which slopes downwardly toward the left as viewed in FIG. 1, and a wagon 86 or other wheeled vehicle is positioned on the sloping guideway 54*a* in a receiving position ready to receive a toy 20 from the cradle 74 of the discharge gate after the gate is pivoted downwardly in a counterclockwise direction by the force of the moving toy moving from the ramp 60. The awaiting wagon 86 is maintained in the ready position on the upper end of the guideway 54*a* by means of a relatively shallow transversely extending hump or ridge 54*b* which engages the rear wheels of the wagon to hold the wagon in readiness until the force of a toy being deposited therein from the discharge gage causes the wheels to ride up over the ridge so that the wagon can move down the ramp and out onto an adjacent playing surface as indicated by the arrow "A" (FIG. 1). As illustrated, the cradle portion 74 of the discharge gate 76 includes a lip 74*a* which is adapted to engage the rear end of the wagon body and provides an overlapping ledge allowing the rolling toy to move easily across into the wagon body. After the rolling toy has been discharged into the wagon and the wagon rolls down the guideway 54*a*, the rubberbands 52 are effective to bias the discharge gate 76 in a clockwise direction back to the upright ready position as shown, in readiness for receiving the next rolling toy 20 which comes down the ramp 60. The elevator or lift unit 66 is not biased and is manually moved between the lower or toy receiving position as shown and an upright or discharge position as described, by manipulation of the finger tabs 72 on the legs.

From the foregoing, it will be seen that the rolling toy 20 in combination with the ramp assembly 50 provides entertainment and amusement as well as action for young children and the like and in addition, the apparatus facilitates the improvement of the manual dexterity and motor skills of persons playing with the combination.

Figure 2:
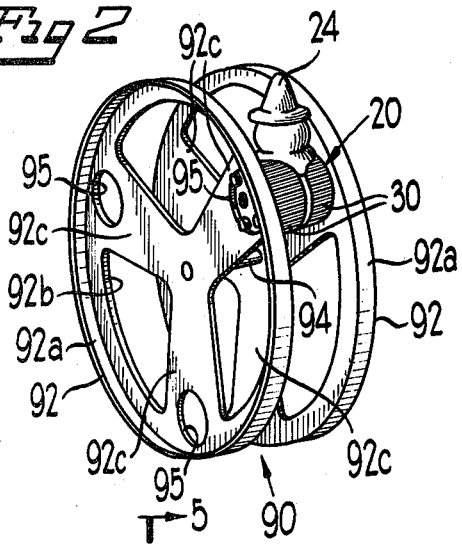
FIG. 2 is a perspective elevational view of another embodiment of a rolling toy game apparatus combination in accordance with the features of the present invention.

Referring now to FIG. 2, therein is illustrated a rolling toy 20 in combination with a rolling carriage apparatus generally indicated by the reference numeral 90. The carriage includes a pair of relatively large, spaced apart, generally circular carriage rings or wheels 92 preferably formed of flexible, resilient, integrally molded plastic material and interconnected to one another in coaxially spaced apart relation by means of a shaft 94. The carriage rings 92 are identical to one another and each includes an outer rim 92*a* which is stiffened by a radial rim portion 92*b* of circular shape which is interconnected to the central shaft 94 by a plurality of relatively wide spokes 92*c*. Each spoke is provided with a circular opening or recess 95 adjacent the outer rim as illustrated and each recess is dimensioned with an inside diameter substantially equal or slightly larger than that of a circle which would encircle and be tangent outwardly of the key projections 42 on the side faces 32 of the rolling toy wheels 30. Because the rings are formed of relatively thin, flexible plastic material, the spokes are deflectable outwardly away from one another in order that a rolling toy 20 may be snapped into position with the keys 42 on each wheel seated within the recesses 95 in the spaced apart rings 92 as illustrated. Inward pressure from the spokes 92*c* against the opposite sides of the wheels 30 of the rolling toy retain the toy in the circular carriage as it rotates on a supporting play surface. As the carriage rolls, the balance weights 40 in the interior of the rolling toys always maintain the heads 24 in an upright position as shown much like the persons sitting in a ferris wheel.

Circular rings 92 are large enough in diameter so that a toy 20 in position as shown, held by the spaced apart rings in any of the several pairs of coaxially aligned recesses 95 will freely clear and pass below the central shaft 94 as the toys move in a circular path around the shaft through a lowermost position. A number of toys may be mounted in the carriage with one for each pair of coaxial recesses 95 or a lesser number of toys can be used. When a lesser number of toys are used, a radial unbalance is present in the carriage 90 as shown in FIG. 2, and when this occurs, the rolling action of the carriage is uneven and jerky as the carriage rolls along a playing surface. The inward pressure of the resilient rings 92 firmly hold the rolling toys 20 in position as shown until such time as the rings are manually deflected outwardly and the toys are then manually removed from the carriage.

From the foregoing it will be seen that a combination of rolling toys 20 and the carriage roll assembly 90 provides interesting and exciting action for a young child.

Figure 3:
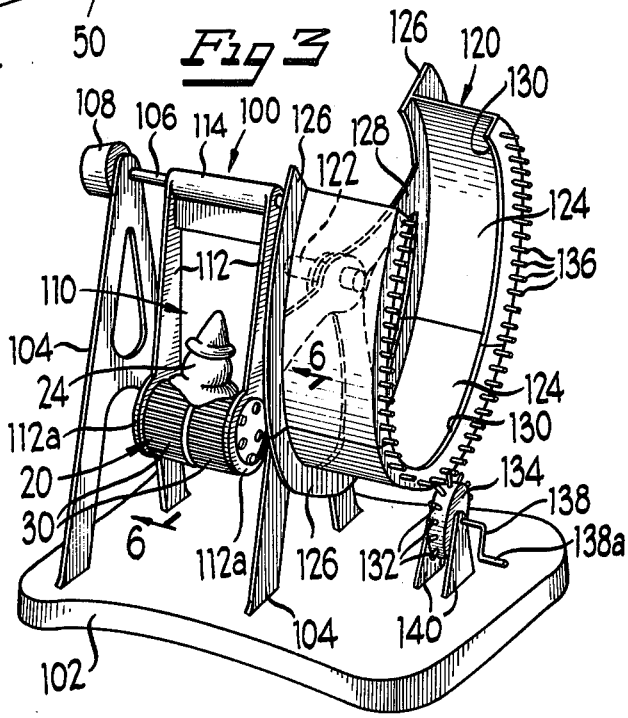
FIG. 3 is yet another embodiment of a rolling toy game apparatus combination constructed in accordance with the features of the present invention.
Figure 6:
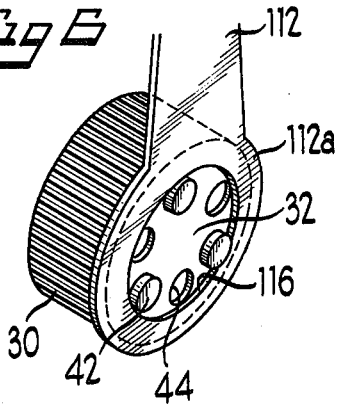
FIG. 6 is a fragmentary enlarged elevational view looking in the direction of arrows 6—6 of FIG. 3.

Referring now to FIGS. 3 and 6, therein is illustrated one of the rolling toys 20 in combination with a swing assembly generally indicated by the reference numeral 100. The swing assembly 100 includes a base 102 and a pair of spaced apart, upstanding, support frames 104 which provide support for a horizontal shaft 106 adjacent the upper end of the frames. The shaft is rotatable by means of a knob 108 at the outer end thereof and provides support for a swing assembly 110 which is adapted to support a rolling toy 20 as shown between a pair of spaced apart arms 112 interconnected at the inner ends in spaced apart relation as shown by a spacer element 114 rotatable with the shaft 106. At the outer end, each arm is formed with an enlarged circular end portion 112*a* having a circular opening 116 which is adapted to receive and encircle the key projections 42 on each wheel of a rolling toy which is snapped into position between the arms as shown. The outer end portions 112*a* of the swing arms are manually deflectable away from each other in order to snappingly receive a rolling toy 20. After a toy is positioned in coaxial alignment with the circular openings 116 in the swing arms, the arms are released to deflect back inwardly to seat against the side faces 30 of the wheels and hold the toy firmly in position as shown with the key elements 42 of each wheel seated within the circular openings as shown. In this position, a rolling toy 20 is firmly retained in the swing 110 at the outer end portion 112*a* of the swing arms 112 so that when the knob 108 is rotated, the arms swing about the axis of the shaft and the rolling toy moves around a circular path. As the rolling toy is thus moved about the relatively large circular path, the head portion 24 is maintained in continuous upright position as shown by the balance weights 40 and the arms 112 of the swing are long enough to permit the head portion 24 to freely pass below the shaft and spacer structure 114 without interference.

FIG. 6 illustrated in enlarged detail, the supporting engagement between the key projections 42 on the wheels 30 of a rolling toy 20 when seated with a circular opening 116 of the enlarged outer end portion 112*a* of a swing arm 112. In order to remove a rolling toy from the swing, the outer end portions of the arms 112 are deflected outwardly away from one another and the toy is then easily dismounted from the swing. The toys are normally held in position in the swing by the inward pressure of the swing arms 112 and the spacing between the arm is substantially equal to the distance between the outer side faces 32 of the wheels 30 of the rolling toys.

In accordance with the invention, the A-frame member 104 which extends upwardly from the central portion of the base 102 also provides support for a cylindrical cage assembly 120 which is carried on an outwardly extending supportive shaft 122 parallel of the shaft 106 and extending toward an opposite side of the base. The shaft 122 provides support for a plurality of arcuately curved segments 124 which are arranged to rest in end to end relation as shown to form a travel path or track comprising a substantial fraction of a complete circle and adapted to contain one or more of the rolling toys 20. Each curved track section 124 includes an inside wall section supported from the shaft 122 for independent free rotation by means of a radial arm 128 and all of the track sections are independently rotatable on the shaft 122. Each track section also includes an outer sidewall 130 having a plurality of outwardly extending drive pins 132 along a circular path at equally spaced intervals. The inside and outside wall sections 126 and 130 of each track section 124 are spaced apart slightly wider than the overall width of the rolling toys 20 so that when a toy is placed in the track of the cage-like structure it may roll freely between the several track sections toward the lowest level as the sections are moved about a circular path around the shaft. It should be noted that the length of each track section is approximately one quarter of the total circumference of the cage-like structure but that a gap or space comprising a small fractional portion of the complete circle is present. In the gap or space between the upper ends of the uppermost tracks there is no track guidance for the rolling toys and this fractional gap is always present at the uppermost portion of the cage-like structure because the weight of the respective tack sections 124 always tends to return the sections to the lowermost positions in end to end relation as shown. The rolling toys will always tend to move toward and come to rest in the middle track section at the bottom of the circle.

In order to rotate the track sections, there is provided a drive wheel 134 having a plurality of radial drive pins 136 around the outer circumference thereof and these pins engage the drive pins 132 on the outer sidewalls 130 of the track sections 124. The drive wheel 134 is supported on a crank shaft 138 between a pair of upstanding brackets 140 secured to the base 102 and when the crank shaft is manually rotated by turning an eccentric crank handle 138*a*, the track sections 124 move in unison around the circular path until such time as an uppermost track section passes over dead center. When this occurs, the track section at the upper end of the circular path flips over the top and momentarily closes the gap or space at the lower portion of the circular cage structure. This process is repeated as each new track section 124 reaches a swing over or balance point as the crank arm 138*a* is turned. Accordingly, when rolling toys are placed in the cage-like structure formed by the end to end track sections 124 and the crank arm is rotated rapidly, the toys tend to climb upward in the cage structure with the moving track sections and they tend to follow the track sections which reach the swing over point. At this time, the toys also follow the swing over action of the track sections and descend down toward a lower position on the opposite side of the cage-like structure. The unique combination provides interesting action for the rolling toys 20 and as each track section reaches the swing over point it provides a new path for the following rolling toy which moves continuously around a circular path in the cage-like structure.

Figure 8:
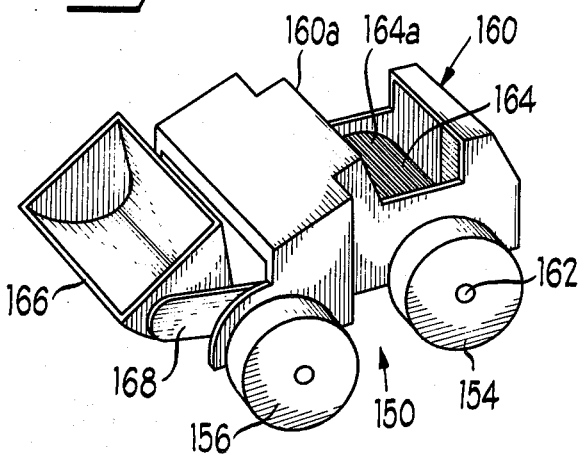
FIG. 8 is a perspective view of a wheeled vehicle constructed in accordance with the features of the present invention and adapted to be used in combination with the rolling toys of the invention.
Figure 9:
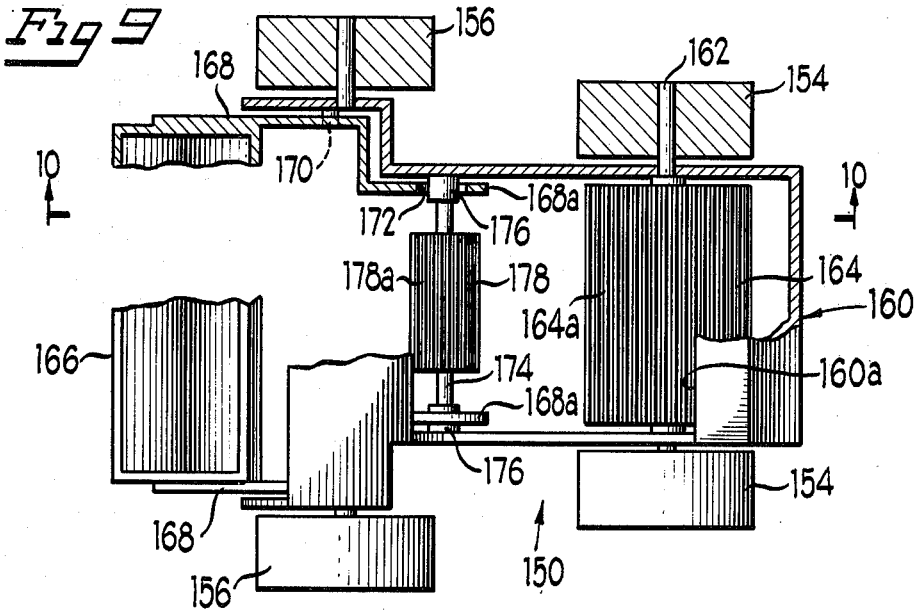
FIG. 9 is a top plan view of the vehicle of FIG. 8 with portions broken away and in section.
Figure 10:
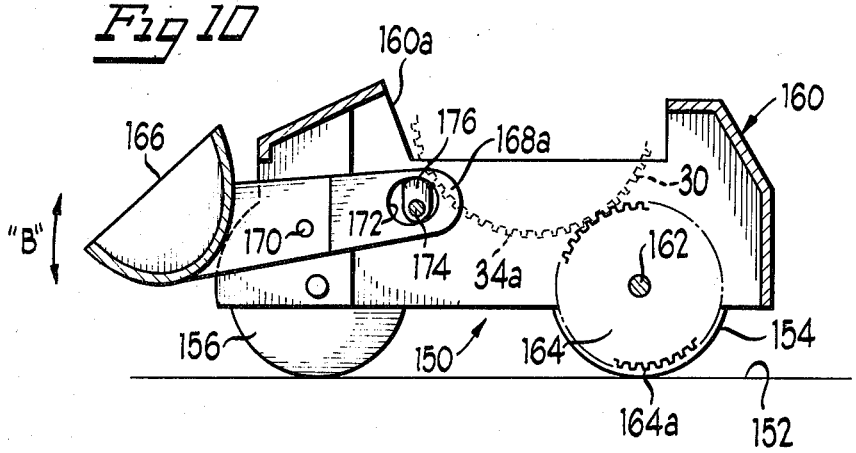
FIG. 10 is a longitudinal, vertical, sectional view taken substantially along lines 10—10 of FIG. 9.

Referring to FIGS. 8, 9 and 10, the rolling toys 20 are adapted to be used in combination with a wheeled vehicle 150 which is adapted to manually move over a playing surface or area 152 while supported on a pair of rear wheels 154 and a pair of independent front wheels 156. The vehicle is designed to resemble a tractor or scoop truck and includes a body 160 preferably formed of integrally molded plastic material. The rear wheels 154 are mounted on an axle 162 which projects through openings in opposite sidewalls of the body and between these sidewalls a drive drum 164 is mounted and includes a plurality of drive teeth 164*a* adapted to drivingly engage the teeth 34*a* on the wheels of one or more rolling toys 20 placed in the tractor body. Toys are adapted to be positioned and supported on the drive drum as indicated in phantom in FIG. 10 and for this purpose, the body 160 is formed with a relatively large open area or cockpit 160*a* in the top wall and the opposite sidewalls. One or more of the rolling toys may be placed in the cockpit for movement with the tractor.

At the forward end, the tractor includes a scoop or bucket 166 carried at the outer ends of a pair of support arms 168 which are mounted for pivotal movement on short axles 170 projecting inwardly from opposite inside wall surfaces of forwardly extending portions of the vehicle body. Preferably, the support arms 168 are integrally formed with the scoop bucket 166 and include rear end portions 168*a* extending rearwardly of the pivot axis and formed with elongated openings 172 therein as shown in FIGS. 9 and 10. A transverse shaft 174 is mounted in the body to extend between opposite sidewalls parallel and forward of the rear axle 162 in spaced apart relation as shown in FIGS. 9 and 10. The shaft 174 extends through the circular openings 172 in the rearward end portions 168*a* of the bucket support arms and a pair of eccentric cams 176 are carried on the shaft for driving engagement with the surfaces of the arm openings 172 thereby causing the arms 168 to rock or oscillate as the shaft turns. The shaft is driven by a toothed drum 178 having a plurality of teeth 178*a* around the circumference and adapted to be drivingly engaged with the teeth 34*a* of one or more rolling toys 20 carried by the tractor. Referring to FIG. 10, when a rolling toy is placed in the recess 160*a* of the tractor body, the teeth 34*a* thereof are rotated by the rear axle drive drun 164 and the toy in turn causes the forward drum 178 to rotate. The eccentric cams 176 move the rearward end portions 168*a* of the bucket support arms up and down causing the bucket itself to oscillate up and down as indicated by the arrow "B" whenever the rear wheels of the vehicle 150 are turned by movement over a playing surface 152.

From the foregoing it will be seen that one or more of the rolling toys 20 used in combination with the truck or vehicle 150 provides a drive element for the vehicle which causes the bucket or scoop 166 at the forward end to oscillate up and down as the vehicle's rear wheels are turned by manually moving the vehicle around a playing surface.

Although the present invention has been described with reference to several illustrated embodiments thereof, it should be understood that numerous other modifications and embodiments can be devised by those skilled in the art that will fall within the spirit and scope of the principles of this invention.

What is claimed as new and desired to be secured by Letters Patent of the United States is:

1. A rolling toy comprising:

a pair of wheels mounted on a common axle with inside faces of said wheels in spaced apart relation;

a body mounted for free rotation on said axle between said inside faces including a head portion projecting upwardly above said wheels and a lower portion below said axle;

weight means for said lower portion for maintaining said head portion in an upright position as said wheels rotate; and connecting means on the exterior of said wheels for connecting the rolling toy to another like toy in cooperative engagement for movement therewith.

2. The rolling toy of claim 1 wherein said wheels include an outer rim portion and a central hub portion spaced inwardly thereof forming a hollow annular recess, said weight means including at least one element extending outwardly into said recess.

3. The rolling toy of claim 1 wherein said wheels include an outer rim and central hub spaced radially inwardly thereof and an outer sidewall integrally joining said rim and side wall.

4. The rolling toy of claim 1 wherein said head portion includes laterally extending side portions overlying upper portions of said wheels.

5. The rolling toy of claim 1 wherein said wheels include outer rims formed with a plurality of radial teeth around the circumference thereof.

6. The rolling toy of claim 3 wherein said outer sidewalls include a plurality of outwardly extending projections disposed in symmetrical relation to said axle and a plurality of inwardly extending recesses disposed in symmetrical relation to said axle and angularly offset from said projections, said recesses adapted to receive projections of an adjacent rolling toy in removable interlocking relation whereby a plurality of said toys may be assembled together side by side with their axles in coaxial alignment and their wheels rolling in unison.

7. The rolling toy of claim 1 wherein said connecting means includes wheels having outer sidewalls, said sidewalls including a plurality of outwardly extending projections spaced symmetrically with respect to said axle and a plurality of inwardly extending recesses spaced symmetrically with respect to said axle and angularly offset from said projections, said recesses adapted to receive projections of an adjacent rolling toy in removable interlocking relation whereby a plurality of said toys may be assembled together side by side with their axles in coaxial alignment and their wheels rolling in unison.

8. The rolling toy of claim 1 wherein said wheels include key means projecting outwardly of outer side faces thereof and symmetrical with respect to said axle and inwardly of said outer rim.

9. The rolling toy of claim 8 in combination with a rolling carriage comprising a pair of spaced apart circular elements interconnected by a central shaft, said circular elements having a diameter large enough to pass said rolling toy beneath said shaft in an upright position between said elements, said circular elements including laterally outwardly deflectable portions radially outward of said shaft with at least one pair of coaxially aligned recesses in said elements adapted to receive said key means of said toy removably retained between said circular elements for rolling movement therewith.

10. The rolling toy and carriage combination of claim 9 wherein said circular elements include a plurality of pairs of coaxially aligned recesses for receiving said key means of a plurality of said toys for rolling movement therewith.

11. The rolling toy and carriage combination of claim 10 wherein said pairs of recesses in said circular elements are equilaterally spaced around said shaft.

12. The rolling toy of claim 1 in combination with a toy vehicle including a body and at least one supporting drive wheel rotatable upon movement of said vehicle across a playing surface, and a drive roll in said body interconnected to turn with said drive wheel and adapted to support one or more of said toys in driving engagement for roating the wheels thereof upon movement of said vehicle.

13. The rolling toy and vehicle combination of claim 12 wherein said wheels of said toy include teeth around the circumference thereof adapted for driving engagement with teeth provided on said drive roll of said vehicle.

14. The rolling toy and vehicle combination of claim 12 including an idler roll in said vehicle body adapted to be driven by rotation of said wheels of said toy supported thereby.

15. The rolling toy and vehicle combination of claim 14 wherein said drive roll and said idler roll are mounted on spaced apart shafts extending transversely of said vehicle body below the common axle of said toy.

16. The rolling toy and vehicle combination of claim 14 wherein said vehicle body include an an opening in an upper wall thereof for accommodating said toy vehicle supported on said drive roll and idler roll.

17. The rolling toy and vehicle combination of claim 16 wherein said body includes a pair of sidewalls on opposite sides of said opening for limting lateral displacement of said toy carried by said vehicle.

18. The rolling toy and vehicle combination of claim 14 wherein said vehicle includes an oscillating element pivotally mounted on said body, and eccentric crank means drivingly interconnecting said idler roll and said element to oscillate the element upon rotation of said idler roll by engagement with the wheels of said toy supported in said vehicle body.

19. The rolling toy and vehicle combination of claim 18 wherein said oscillating element includes a scoop adjacent a forward end of said body movable up and down during said oscillating movement.

20. The rolling toy of claim 1 in combination with a ramp assembly, said ramp assembly including an elevated track for guiding the rolling wheels of said toy from an entry end toward a lower discharge end, pivotal lift means for elevating said toy and depositing the same on the entry end of said track and a pivotal discharge gate biased toward an upright position for receiving said rolling toy from the discharge end of said track and movable by the force of said toy toward a releasing position for discharging said toy at a level below said discharge end of said track.

21. The rolling toy and ramp assembly comgination of claim 20 wherein said elevated track includes leg means for supporting said entry and discharge ends thereof.

22. The rolling toy and ramp assembly combination of claim 21 wherein said lift assembly includes arm means pivotally attached to said leg means and a cradle at the outer end of said arm means for supporting said toy, said arm means manually pivotal between a lower position with said cradle at a level below said track for receiving said toy and an upwardly extending position wherein said cradle is adjacent the entry end of said track for delivering said toy thereto.

23. The rolling toy and ramp assembly combination of claim 21 wherein said discharge gate includes a cradle at the outer end of arm means which is pivotally secured to said leg means of said track, said cradle including a receiving surface projecting above said discharge end of said track when said gate is in said upright position for engagement by said rolling toy to pivot said gate toward said releasing position.

24. The rolling toy and ramp assembly combination of claim 21 wherein said leg means includes a pair of spaced apart sidewalls of inverted U-shape with a bight portion of said sidewalls guiding said rolling toy along said track.

25. The rolling toy and ramp assembly combination of claim 24 including a pair of spaced apart bases for supporting legs of said U-shaped sidewalls, one of said bases supporting said lift means in a lower position for receiving said toy and the other of said bases including a guide track for a wheeled vehicle adapted to receive said rolling toy from said discharge gate when pivoted downwardly to said releasing position.

26. The rolling toy and ramp assembly combination of claim 25 wherein said guide track of said other bases slopes downwardly away from said elevated track, and stop means on said guide track engaging a wheel of said wheeled vehicle for retaining the same in a receiving position until receiving said toy from said discharge gate.

27. The rolling toy of claim 8 in combination with a swing assembly, said swing assembly including an upstanding frame with a swing support shaft, a swing mounted for free rotation on said support shaft, said swing comprising a pair of spaced apart arms having coaxially aligned openings adjacent free outer end portions adapted to detachably support said key means of said wheels of said rolling toy in coaxial alignment therewith, and spacer means on said support shaft interconnecting said arms and mounting said arms for pivotal movement on said shaft.

28. The rolling toy and swing assembly combination of claim 27 wherein said free outer end portions of said arm are deflectable to permit said rolling toy to be detachably mounted with said key means inserted in said openings.

29. The rolling toy and swing combination of claim 27 wherein said arms are long enough to permit said rolling toy carried thereby to pass below said spacer means.

30. The rolling toy and swing combination of claim 27 wherein said frame includes a base and a pair of spaced apart uprights thereon for supporting said shaft at a level above said base sufficient to permit free pivotal movement of said arms and rolling toy carried thereby between said uprights below said shaft and above said base.

31. The rolling toy and swing combination of claim 27 including knob means for rotating said arms to swing said rolling toy carried thereby around said shaft.

32. The rolling toy of claim 1 in combination with a roller track assembly, said roller track assembly including a plurality of curved track elements for supporting and guiding said rolling toy for rolling movement therein between opposite ends, said track elements normally aligned in abutting end to end relation and curved about a common support shaft to form a circularly curved track around said shaft comprising a substantial fraction of a complete circle, independent arm means for each track element supporting the same for free swinging movement around a circular path concentrically of said shaft, and motor means engageable with said track elements for rotating the same around said shaft.

33. The rolling toy and roller track assembly combination of claim 32 wherein said substantial fraction is greater than one half.

34. The rolling toy and roller track assemby combination of claim 32 wherein each track element and its associated support arm are integrally formed into a cage segment for said rolling toy each cage segment being substantially identical to the others in weight and balance with respect to said shaft.

35. The rolling toy and roller track assembly combination of claim 32 wherein said shaft is horizontal and track elements are movable around a vertical plane above and below the level of said shaft.

36. The rolling toy and roller track assembly combination of claim 32 wherein said motor means includes a manual crank and sprocket rotated thereby in rotative driving engagement with said track elements.

* * * * *